US009003609B2

(12) United States Patent
Dilo

(10) Patent No.: US 9,003,609 B2
(45) Date of Patent: Apr. 14, 2015

(54) DEVICE AND METHOD FOR FORMING A UNIFORM OR PROFILED FLEECE OR A UNIFORM OR PROFILED FIBER FLOCK MAT

(71) Applicant: Oskar Dilo Masc hinenfabrik KG, Eberbach (DE)

(72) Inventor: Johann Philipp Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 0 days.

(21) Appl. No.: 13/959,965

(22) Filed: Aug. 6, 2013

(65) Prior Publication Data

US 2014/0033480 A1 Feb. 6, 2014

(30) Foreign Application Priority Data

Aug. 6, 2012 (EP) ..... 12179382
Dec. 28, 2012 (EP) ..... 12199616

(51) Int. Cl.
*D04H 1/736* (2012.01)
*D04H 11/08* (2006.01)
*D01G 23/04* (2006.01)

(52) U.S. Cl.
CPC ..... *D04H 1/736* (2013.01); *D04H 11/08* (2013.01); *D01G 23/04* (2013.01); *D01G 23/045* (2013.01)

(58) Field of Classification Search
CPC ..... D04H 1/736; D04H 11/08; D01G 23/04; D01G 23/045
USPC ..... 19/65 A, 296, 300, 303, 304, 161.1
See application file for complete search history.

(56) References Cited

U.S. PATENT DOCUMENTS 2,822,028 A 2/1958 Himmelheber et al.
3,067,855 A 12/1962 Lambert
(Continued)

FOREIGN PATENT DOCUMENTS

CH 490526 A 5/1970
DE 19541818 A1 5/1997
(Continued)

OTHER PUBLICATIONS

Database WPI, Week 197508. Thomson Scientific, London, GB; AN 1975-13623W, XP002694620,-&JP S 50 2183 BI (Noda Playwood Mfg. Co.) Jan. 24, 1975.
(Continued)

*Primary Examiner* — Shaun R Hurley
(74) *Attorney, Agent, or Firm* — Jansson Munger McKinley & Shape Ltd.

(57) ABSTRACT

The device for producing a uniform or profiled fleece or a fiber flock mat includes a material dispensing device which produces a fleece and a transport device for the further transport of the fleece. The device also includes a measuring device to determine a transverse profile and a longitudinal profile of the fleece by measuring the mass per unit area of the fleece across its width, and a profile-changing device for supplying individualized fibers or fiber flocks to the fleece. A control unit controls the profile-changing device on the basis of the results of the measuring device in such a way that the profile-changing device supplies the individualized fibers or fiber flocks section by section in a targeted manner. Thus, depending on the purpose of the application, a uniform fleece or a fleece with a nonuniform transverse profile or longitudinal profile can be produced.

17 Claims, 13 Drawing Sheets

(56) References Cited

U.S. PATENT DOCUMENTS

| | | | | |
|---|---|---|---|---|
| 4,155,968 | A | 5/1979 | Eumi et al. | |
| 5,269,049 | A * | 12/1993 | Gustafsson et al. | 19/304 |
| 2006/0071360 | A1 * | 4/2006 | Kuchenbecker et al. | 264/115 |
| 2006/0143869 | A1 * | 7/2006 | Pohlmann | 19/1 |
| 2014/0034399 | A1 * | 2/2014 | Dilo | 177/119 |

FOREIGN PATENT DOCUMENTS

| | | | |
|---|---|---|---|
| DE | 19919447 | A1 | 11/2000 |
| DE | 19923418 | A1 | 11/2000 |
| DE | 102011016343 | A1 | 12/2011 |
| EP | 0161323 | A1 | 11/1985 |
| EP | 0972866 | A2 | 1/2000 |
| EP | 1887113 | A1 | 2/2008 |
| JP | 7138861 | A | 5/1995 |

OTHER PUBLICATIONS

Excerpts of European Search Report for EP Application No. 12 17 9382. 2 pages. Date: Oct. 26, 2012.

Excerpts of European Search Report for EP Application No. 12 19 9616. 3 pages. Date: Mar. 28, 2013.

* cited by examiner

DEVICE AND METHOD FOR FORMING A UNIFORM OR PROFILED FLEECE OR A UNIFORM OR PROFILED FIBER FLOCK MAT

CROSS REFERENCE TO RELATED APPLICATIONS

This application claims priority based on European patent applications EP 12 179 382.2, filed Aug. 6, 2012 and EP 12 199 616.9, filed Dec. 28, 2012.

FIELD OF THE INVENTION

The invention relates to a device and a method for forming a uniform or profiled fleece or a uniform or profiled fiber flock mat.

BACKGROUND OF THE INVENTION

When fiber fleeces are produced, fiber flocks are first dispensed from a fiber flock feeder to a transport device, which, in a first alternative, transports them in the form of a fiber flock mat to a fiber web forming device, preferably a carding machine. In a second alternative, they are transported directly to an aerodynamic fleece former, or, in a third alternative, they are transported directly to a solidification machine such as a needling machine.

In the first alternative, the carded web formed in the fiber web forming device (which can also be called a single-layer or double-layer fleece) is then sent to a fleece layer, which lays the fiber web to form a multi-layer fleece by cross-lapping. This multi-layer fleece can then be solidified by a suitable solidification machine such as by a needling machine. Overall, the goal is usually to produce a fiber fleece with a very high degree of uniformity. For this purpose, appropriate means of intervening in the process are present at various locations of the production line. For example, in the area between the fiber flock feeder and the web-forming device, the weight, for example, of the fiber flock mat can be measured by a belt weigher, and on this basis the infeed rate of the web-forming device is controlled in such a way that the quantity of fiber material which arrives in the web-forming device per time unit is always the same.

Nevertheless, a belt weigher of this type can determine only the average weight of the fiber flock mat distributed across the width of the transport device and over a certain length in the transport direction. For this reason, the uniformity of the fiber flock stream entering the web-forming device obtained by this equalizing method is only roughly approximate, and the mass per unit area of the fiber flock mat can thus vary across the width of the fiber flock mat, a situation which must be tolerated.

In the case of the second and third fleece-forming alternatives mentioned above, attempts have been made in the past through various adjustments within the processing stations and through various design details to dispense the fiber flocks in the fiber flock feeder to form a fiber flock mat and to deliver the individualized fibers in the aerodynamic fleece-forming machine to form a fiber fleece as uniformly as possible over the length and width of the fiber flock mat or fleece. The results, however, have often been in need of improvement.

In addition to making a uniform fiber flock mat or fleece, it can also be advantageous in other cases for the transverse profile and/or longitudinal profile of the fiber flock mat or the fleece to comprise a predetermined type of nonuniformity.

SUMMARY OF THE INVENTION

It is an object of the present invention to compensate for locally delimited thin or thick sections in a fleece or fiber flock mat and thus also of ensuring a constant distribution of the mass per unit area transversely across the width of the fleece or fiber flock mat or of effectively arriving at a desired non-uniform transverse profile and/or longitudinal profile of the fleece or fiber flock mat.

According to an aspect of the invention, the device for forming a uniform or profiled fleece or a uniform or profiled fiber flock mat comprises a material dispensing device, which produces a fleece or a fiber flock mat of predetermined width, and includes a transport device, downstream from the material dispensing device, for the further transport of the fleece or fiber flock mat in a transport direction. The device also comprises a measuring device for measuring the mass per unit area of the fleece or fiber flock mat across its width, i.e., transversely to its transport direction, in a measuring area of the transport device to determine the transverse profile and longitudinal profile of the fleece or fiber flock mat; and a profile-changing device in a profile-changing area downstream from the measuring area, wherein the profile-changing device comprises a feed device for supplying individualized fibers or fiber flocks to the fleece or the fiber flock mat or a removal device for removing individualized fibers or fiber flocks from the fleece or fiber flock mat. In addition, the device comprises an open-loop or closed-loop control unit, which is designed to control the profile-changing device on the basis of the results of the measuring device. This can be done in such a way that the profile-changing device supplies individualized fibers or fiber flocks to the identified thin sections in the fleece or fiber flock mat or removes individualized fibers or fiber flocks from the identified thick sections in the fleece or fiber flock mat to produce a uniform fleece or fiber flock mat. It may also be done in such a way that the profile-changing device supplies individualized fibers or fiber flocks to specific sections or removes them from specific sections to form the desired nonuniform transverse or longitudinal profile of the fleece or fiber flock mat with thin sections and thick sections.

In this way it is possible to influence the profile of the fleece or fiber flock mat in two directions in a targeted manner and thus to produce either a fleece or a fiber flock mat with a relatively constant mass per unit area over its entire length and width or to produce a desired nonuniform transverse profile and/or longitudinal profile of the fleece or fiber flock mat.

In a preferred embodiment, the measuring device is a radiometric measuring device, which can precisely determine the mass per unit area of the fleece or fiber flock mat. The measuring device can comprise a single radiometric measuring element, which is moved across the width of the fleece or fiber flock mat. It is also possible to provide several stationary radiometric measuring elements, which are arranged at the desired measurement intervals next to each other across the fleece or fiber flock mat transversely to the transport direction.

It is also possible for the measuring device to be a mechanical measuring device.

If is preferable for the measuring device to comprise several measuring wheels arranged next to each other transversely to the transport direction, the deflections of these measuring wheels being recorded by an evaluation unit. In this way, it is possible to efficiently record the transverse profile of the fleece or fiber flock mat transversely to the transport direction. In addition, on the basis of the movement of the fleece or fiber flock mat, it is possible to record the longitudinal profile of the fleece or fiber flock mat with the desired degree of local resolution and to make the result available as an electrical signal for further processing.

The profile-changing device preferably comprises several feed segments arranged horizontally next to each other transversely to the transport direction. These feed segments are being actuated independently of each other by the control unit. Such construction provides that the data supplied by the measuring device will lead to accurately targeted corrections to the fleece or fiber flock mat (preferably as the filling-out of thin sections) or to the formation of the desired profile of the fleece or fiber flock mat with a relatively high degree of resolution.

The resolution is determined substantially by the width of the individual feed segment. It is preferred for each feed segment to have a width in the range of 5-100 mm, preferably of 15-30 mm, and even more preferably of 20-25 mm.

The material dispensing device can be a fiber flock feeder, which produces a fiber flock mat, or a fleece former. A "fleece former" according to the definition used herein includes aerodynamic fleece-forming devices, but can also be a web forming device or a fleece layer.

The feed device for supplying individualized fibers or fiber flocks to the fleece or to the fiber flock mat preferably comprises several rollers of the same type arranged in a row across the width of the fleece or fiber flock mat. These rollers may be actuated independently of each other by the control unit. One roller is assigned to each feed segment. The rollers in question can be in particular intake rollers or outfeed rollers, it being possible to use the latter as dosing rollers. It is also possible to arrange several different types of rollers in segmented form across the width of the fleece or fiber flock mat. For example, each feed segment can comprise one intake roller and one outfeed roller, both of which correspond to the width of the segment. Other types of guide elements can also be provided, one of which is assigned to each feed segment and possibly also actuated by the control unit. Alternatively, there may be only one of a certain type of element provided, which extends across the width of the fleece or fiber flock mat and affects all of the feed segments simultaneously.

The feed device for supplying individualized fibers or fiber flocks to the fleece or fiber flock mat can, in one embodiment, comprise a fiber flock shaft as a material reservoir.

Alternatively, a dispensing device for storing and dispensing a carded sliver or a fiber fleece strip can be assigned to each feed segment. In this way, a high degree of two-dimensional resolution may be achieved even while the dosing material is being supplied to the feed device.

In a preferred embodiment for the production of fiber flock mats, the material dispensing device is a fiber flock feeder, and the profile-changing device comprises several feed segments arranged horizontally next to each other transversely to the transport direction, which segments can be actuated independently of each other by the control unit. In addition, the feed device for supplying individualized fibers or fiber flocks to the fiber flock mat comprises a fiber flock shaft as material reservoir and is designed as a second fiber flock feeder, wherein one of several outfeed dosing rollers arranged next to each other across the width of the fiber flock mat is assigned to each feed segment. Outfeed dosing rollers can be actuated independently of each other by the control unit. In this way, a uniform fiber flock mat is created, which can be sent directly on to solidification.

Supplementally, one of several deflectable base troughs, arranged next to each other across the width of the fiber flock mat, can be assigned to each feed segment, opposite the associated outfeed dosing roller. The deflection of each base trough is a value which characterizes the actual throughput of material and can therefore be used to monitor the accuracy of the dosing.

The method for forming a uniform or profiled fleece or a uniform or profiled fiber flock mat according to the invention may comprise the followings steps:

- producing a fleece or a fiber flock mat of predetermined width by means of a material dispensing device;
- transporting the fleece or fiber flock mat onward in a transport direction by means of a transport device;
- measuring the mass per unit area of the fleece or of the fiber flock mat across its width in a measuring area of the transport device to determine a transverse profile and a longitudinal profile of the fleece or fiber flock mat; and
- automatically supplying individualized fibers or fiber flocks to the identified thin sections in the fleece or fiber flock mat or removing individualized fibers or fiber flocks from the identified thick sections in the fleece or fiber flock material in a profile-changing area downstream from the measuring area by means of a profile-changing device to produce a uniform fleece or fiber flock mat, or automatically supplying individualized fibers or fiber flocks to the fleece or fiber flock mat or removing individualized fibers or fiber flocks from the fleece or fiber flock mat in a profile-changing area downstream from the measuring area by means of a profile-changing device to produce the desired nonuniform transverse profile or longitudinal profile of the fleece or of the fiber flock mat with thin sections and thick sections.

The controlled feed of fiber flocks is preferably accomplished by independent actuation of several feed segments of the profile-changing device arranged horizontally next to each other transversely to the transport direction.

BRIEF DESCRIPTION OF THE DRAWINGS

Additional features and advantages of the present invention can be derived from the following description, which refers to the drawings in which.

DETAILED DESCRIPTION OF THE INVENTION

Figure 1:
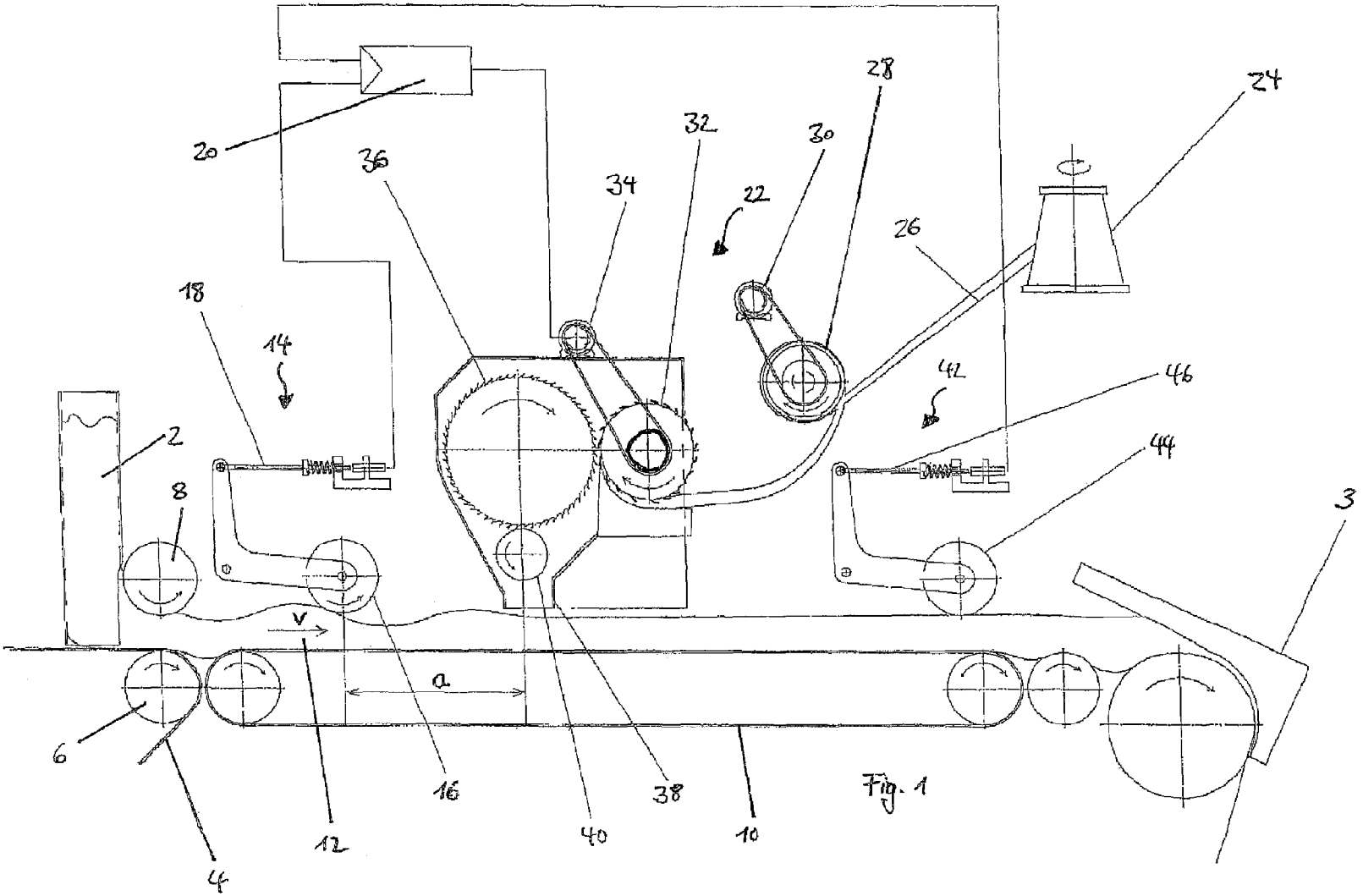
FIG. 1 shows a cross-sectional side view of one embodiment of the device for forming a uniform or profiled fiber flock mat according to the invention.

FIG. 1 shows one embodiment of the device for forming a uniform or profiled fiber flock mat according to the invention. The device comprises a material dispensing device, which is designed here as a fiber flock feeder 2. Downstream from the device, the fiber flock mat which has been produced is sent to the infeed area of a web former 3, especially a carding machine. The fiber flock mat 12 which is produced can also be sent directly to an aerodynamic fleece former (not shown) or to a solidifying machine 50 (see FIG. 2).

Fiber flock feeder 2 dispenses fiber flocks onto an outfeed belt 4, which travels endlessly around a circuit and which is kept under tension by several deflecting pulleys 6, only one of which is shown in the drawing.

To densify the fiber flock material discharged from fiber flock feeder 2, an upper cylinder 8 can also be arranged in the outlet area of fiber flock feeder 2. This upper cylinder 8 is driven in the direction opposite to the direction of pulley 6 of outfeed belt 4 and thus cooperates with outfeed belt 4 to increase the density of the fiber flock mat and to move it forward toward an endless conveyor belt 10. In the embodiment shown here, outfeed belt 4 and conveyor belt 10 together form a transport device, which handles the further transport of fiber flock mat 12.

In the embodiment shown here, transport device 4, 10 connects fiber flock feeder 2 to web former 3. It is also conceivable that conveyor belt 10 could extend directly underneath fiber flock feeder 2 (see the other figures), which would thus eliminate the need for outfeed belt 4, or that the transport device could comprise still other components in addition to elements 4, 10 shown.

On transport device 4, 10, the fiber flock material, now in the form of fiber flock mat 12, is moved forward at a variable speed "v" toward the intake area of web former 3 and thus in the transport direction. Conveyor belt 10 can also comprise a belt weigher, which determines an average weight of fiber flock mat 12 in a two-dimensional weighing area, which has a certain length and extends across the entire width of fiber flock mat 12. On this basis, the transport speed "v" of the transport device and thus simultaneously the infeed speed of web former 3 can be controlled as appropriate, so that substantially the same mass flow of fiber flock material always arrives at the web former 3 per time unit.

A measuring device 14 is provided, which measures the mass per unit area of fiber flock mat 12 across its width transversely to the transport direction in a measuring area of transport device 4, 10, in order to determine the transverse profile and, on the basis of the movement of transport device, 4, 10, also the longitudinal profile of fiber flock mat 12, especially for the purpose of identifying thin sections and/or thick sections in fiber flock mat 12. An important point here is that measuring device 14 comprises several measuring segments arranged transversely to the transport direction of fiber flock mat 12, and that a separate measurement is made in each measuring segment. In this way, thin sections or thick sections can be determined in two dimensions, i.e., in the longitudinal and in the transverse direction. The width of one of these measuring segments is in the range of 5-100 mm, preferably of 15-30 mm, and even more preferably of 20-25 mm. A measuring device of this type can be used in addition to the belt weigher or take over its function.

In the embodiment shown in FIG. 1, measuring device 14 is designed as a row of measuring wheels 16, arranged transversely to the transport direction of fiber flock mat 12 and horizontally next to each other. In the cross-sectional side view shown, only one of these measuring wheels 16 can be seen. Each of these measuring wheels 16 can be deflected independently of the others and is connected to an appropriate evaluation unit 18, which detects the deflection of associated measuring wheel 16 caused by the differences in the thickness, i.e., in the mass per unit area, of fiber flock mat 12. Position sensors for measuring the height of measuring wheels 16 or their mountings or rotational angle meters for determining the rotational angle of measuring wheels 16 or their mountings, for example, could be used for evaluation unit 18. Thus it is possible to draw a conclusion concerning the mass per unit area of fiber flock mat 12 in the associated measurement segment.

Alternatively, measuring device 14 can be designed as some other type of mechanical measuring device. It is also possible for measuring device 14 to be designed as a radiometric measuring device. In this embodiment, either a radiometric measurement probe is arranged in each measurement segment to determine the mass per unit area of fiber flock mat 12 in the measurement segment in question by means of radiometric measurements, or a single radiometric measurement probe is provided, which can be moved transversely across the width of fiber flock mat 12 and which records the mass per unit area of fiber flock mat 12 continuously or at certain measurement intervals. It is also possible to use a combination of a radiometric and a mechanical measuring device 14.

The results provided by measuring device 14 are transmitted to an open-loop or closed-loop control unit 20, which controls a profile-changing device 22 on the basis of the results of measuring device 14. Profile-changing device 22 is arranged in a profile-changing area of transport device 4, 10, downstream from the measurement area and is designed either as a feed device for supplying individualized fibers or fiber flocks to fiber flock mat 12 or as a removal device for removing fiber flocks from fiber flock mat 12. An important point here is that control unit 20 controls profile-changing device 22 in such a way that profile-changing device 22 either supplies individualized fibers or fiber flocks to the identified thin sections in fiber flock mat 12 or removes fiber flocks from the identified thick areas in fiber flock mat 12 to make fiber flock mat 12 uniform. Alternatively, profile-changing device 22 supplies individualized fibers or fiber flocks or removes them in a targeted manner to form a desired nonuniform transverse profile and/or longitudinal profile of fiber flock mat 12 with thin sections and thick sections. A combination of both profile-changing mechanisms (supplying and removing) is also conceivable.

In the case where material is supplied, the automatically controlled supply of individualized fibers or fiber flocks proceeds by independent actuation of several feed segments of profile-changing device 22, which are arranged transversely to the transport direction and horizontally next to each other. In the other embodiment, where material is removed, the automatically controlled removal of fiber flocks proceeds by the independent actuation of several removal segments of profile-changing device 22, which are arranged transversely to the transport direction and horizontally next to each other. The width of one of these feed or removal segments corresponds preferably to the width of the measurement segments. It lies therefore in the range of 5-100 mm, preferably of 15-30 mm, and even more preferably of 20-25 mm.

In the embodiment shown in FIG. 1, profile-changing device 22 is designed as a feed device. The feed segments in question are arranged transversely to the transport direction and thus cannot be seen in the side view of FIG. 1. Assigned to each feed segment is a dispensing device 24 for storing and dispensing a carded sliver 26 or a fiber fleece strip. In the exemplary embodiment shown in FIG. 1, dispensing device 24 is designed as a spool, but it can also be in the form of a sliver can or the like. Carded sliver 26 or the fiber fleece strip travels from dispensing device 24 to a preferably rubber-coated storage drum 28, which is arranged horizontally, transversely to the transport direction, and which extends preferably across all of the feed segments. A winding of each carded sliver 26 or of each fiber fleece strip supplied by dispensing device 24 is wound around storage drum 28, one next to the other. Storage drum 28 is driven in one rotational direction (see the corresponding arrow in the drawing), preferably by means of a servomotor 30 and preferably continuously at relatively slow speed. In certain embodiments, storage drum 28 can also be omitted.

In the preferred embodiment shown in FIG. 1, a one-piece storage drum 28 is present, which holds the various strands of carded sliver 26 or fiber fleece strip for all the feed segments simultaneously, one next to the other. It is also possible to provide a separate storage drum for each feed segment.

Also assigned to each feed segment is an intake roller 32, driven by a servomotor 34 and rotating in the same direction. The intake roller 32 draws off carded fiber sliver 26 or the fiber fleece strip provided by associated dispensing device 24, either directly or indirectly by way of storage drum 28. Although each feed segment comprises its own intake roller 32, only one intake roller 32 can be seen in the drawing because of the way they are arranged one behind the other. Each intake roller 32 preferably comprises a set of surface fittings consisting of teeth projecting backwards with respect to the direction of rotation.

A special advantage of interposing storage drum 28 is that, because carded fiber slivers 26 or fiber fleece strips are wound only loosely around storage drum 28, they are able to slip around it. This slipping effect occurs in all of the feed segments in which intake roller 32 is not being driven at all or is turning more slowly than storage drum 28. Only when intake roller 32 turns faster than storage drum 28 will the corresponding winding of carded fiber sliver 26 or of the fiber fleece strip be pulled taut around storage drum 28, with the result that the material will be drawn away from storage drum 28.

Depending on the quantity of fiber material to be dispensed, intake rollers 32 can have any possible speed profile, including a plateau profile (e.g., in the form of a truncated pyramid) with plateaus of equal height but different lengths.

Carded fiber sliver 26 or fiber fleece strip carried along by intake roller 32 is transported to an opening cylinder 36, which preferably has a one-piece design and extends horizontally, transversely to the transport direction, across all of the feed segments. It is also possible, however, to provide a separate opening cylinder for each feed segment.

In the embodiment shown here, opening cylinder 36 is driven in the same rotational direction as intake rollers 32. In addition, opening cylinder 36 preferably comprises a set of surface fittings consisting of teeth projecting forwards with respect to the direction of rotation, as a result of which it is especially effective at opening the twisted or compacted fiber flock material of carded fiber sliver 26 or fiber fleece strip, so that loose fiber flocks or even fine fibers are individualized. These fall into an appropriate dispensing shaft 38, and from there they are guided onto fiber flock mat 12. It is also possible to provide several dispensing shafts 38 next to each other for the various feed segments.

If desired, a cleaning cylinder 40 can be arranged in the area of dispensing shaft 38. This cylinder strips off the fiber flocks adhering to the teeth of opening cylinder 36.

In the embodiment shown here, the centers of intake rollers 32 and of opening cylinder 36 are arranged on the same horizontal line. In addition to the arrangement shown, however, there are also many other design possibilities.

If desired, the result which has been obtained by profile-changing device 22 can be inspected again downstream by a second measuring device 42. Second measuring device 42 can be designed in the same way as measuring device 14, i.e. it can also comprise several measuring wheels 44 and several associated evaluation units 46.

It is also possible to arrange an additional profile-changing device 22 downstream from second measuring device 42 to deal with cases in which the desired uniformity or the desired transverse or longitudinal profile of fiber flock mat 12 has not been achieved in one step.

So that it can exercise its control function properly during the operation of profile-changing device 22, control unit 20 must therefore take into account not only the local arrangement of the measuring segments and feed segments and the associated measurement data but also the distance "a" between the measuring area and the profile-changing area as well as the associated speed "v" of the transport device, here conveyor belt 10.

When the profile is to be changed, the relevant intake roller 32 of the associated feed segment is then driven at the proper time at a certain speed and thus delivers additional fiber or fiber flock material to opening cylinder 36. The correctly metered quantity of this material then arrives at the desired location on fiber flock mat 12.

If profile-changing device 22 is designed as a removal device, it can work, for example, with mechanical means for gripping fiber material and pulling it away from fleece or fiber flock mat 12. It can also work with suction and draw fiber material away from fleece or fiber flock mat 12 in that way.

There are also other possible ways in which the feed device can be designed. For example, multiple fiber flock shafts can be provided, corresponding to the number of feed segments. Each fiber flock shaft would then be supplied in a targeted manner with loose fiber flocks (branched off, for example, from the fiber flock feeder 2).

Several alternate embodiments of the invention are described below.

Figure 2:
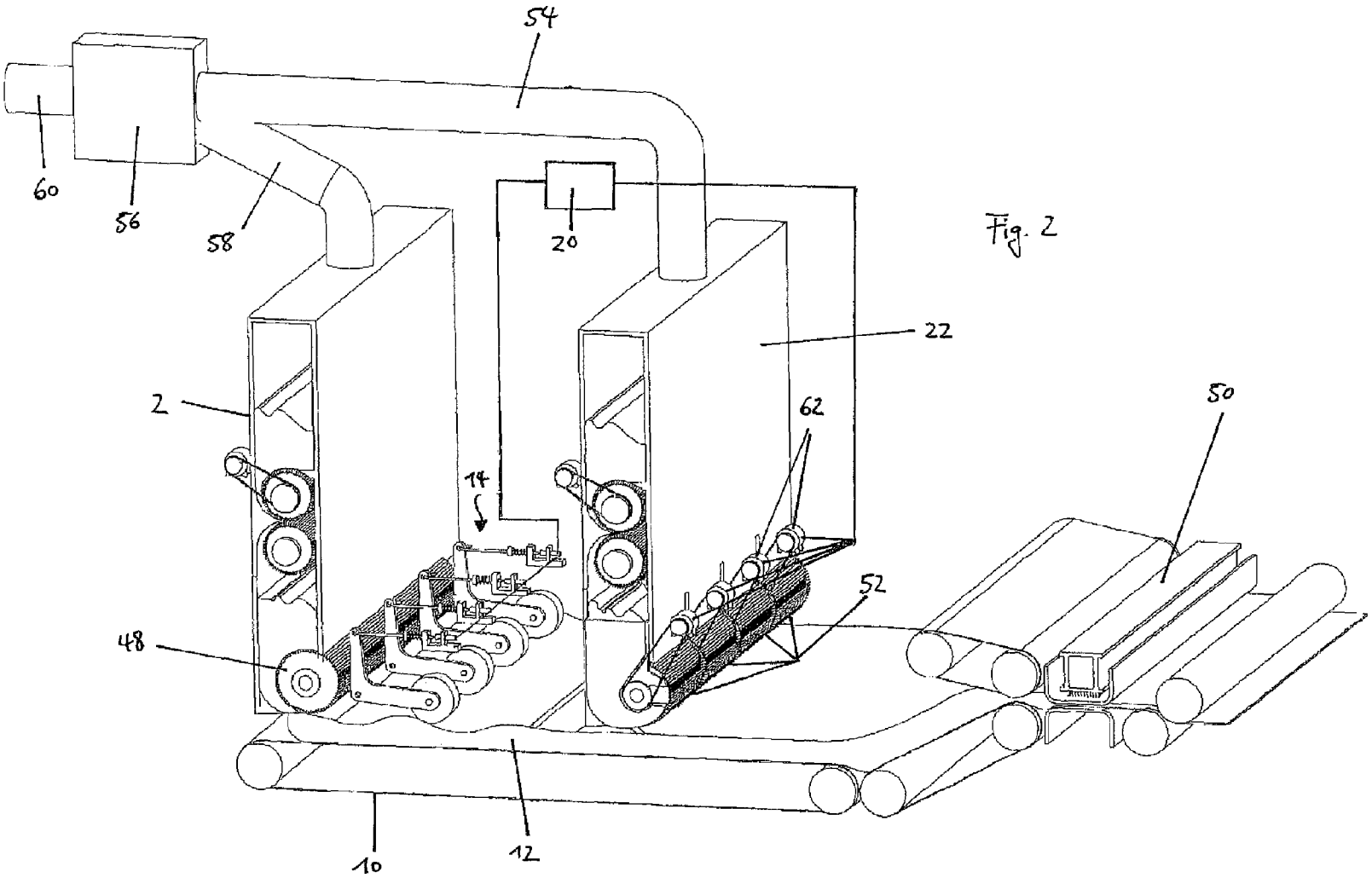
FIG. 2 shows a schematic perspective view of another embodiment of the device for forming a uniform or profiled fiber flock mat according to the invention.

FIG. 2 shows an alternate embodiment of the device for forming a fiber flock mat. The material dispensing device, which produces the base fiber flock mat, is a fiber flock feeder 2 as in the preceding embodiment. In contrast to the embodiment of FIG. 1, the fiber flocks are deposited directly from fiber flock feeder 2 onto conveyor belt 10. Fiber flock feeder 2 can be of any standard commercial design; and, in the embodiment shown here, such feeder 2 comprises at its bottom end an outfeed cylinder 48, extending across the width of conveyor belt 10. Measuring device 14 is of the same design as that in FIG. 1. In the present embodiment, the conveyor belt 10 moves fiber flock mat 12 produced by the device directly to a solidification machine 50, here a needling machine, which is merely suggested schematically.

Profile-changing device 22 in the embodiment of FIG. 2 is also designed as a fiber flock feeder. This fiber flock feeder can be any of the standard commercial fiber flock feeders, but it comprises at its bottom end several feed segments arranged transversely to the transport direction and horizontally next to each other. The feed segments can be actuated independently of each other by control unit 20. One of several outfeed dosing rollers 52, which can be actuated independently of each other by control unit 20, is assigned to each feed segment. Outfeed dosing rollers 52 are arranged transversely to the transport direction and horizontally next to each other. The width of the feed segments, which is substantially similar to the width of outfeed dosing rollers 52, is again preferably in the range of 5-100 mm, more preferably of 15-30 mm, and even more preferably of 20-25 mm. Profile-changing device 22 is filled with fiber flock material through a feed pipe 54, which, as in the embodiment shown here, can branch off from a main feed line 60, as the feed pipe 58 for first fiber flock feeder 2 does. A switching valve 56 can take care of switching between two feed pipes 54, 58. Two feed pipes 54, 58 can also be filled with fiber flock material through separate lines.

On the basis of the measurement results of measuring device 14, each outfeed dosing roller 52 now deposits fiber flock material on the desired locations of fiber flock mat 12. Each outfeed dosing roller 52 is for this purpose connected to its own servomotor 62. Normally, the controlled, two-stage feed of fiber flocks to conveyor belt 10 should produce an absolutely homogeneous, uniform fiber flock mat 12, which is then sent to solidifying machine 50. It is also conceivable, however, that the goal would be to give fiber flock mat 12 a certain desired type of profile.

Figure 3:
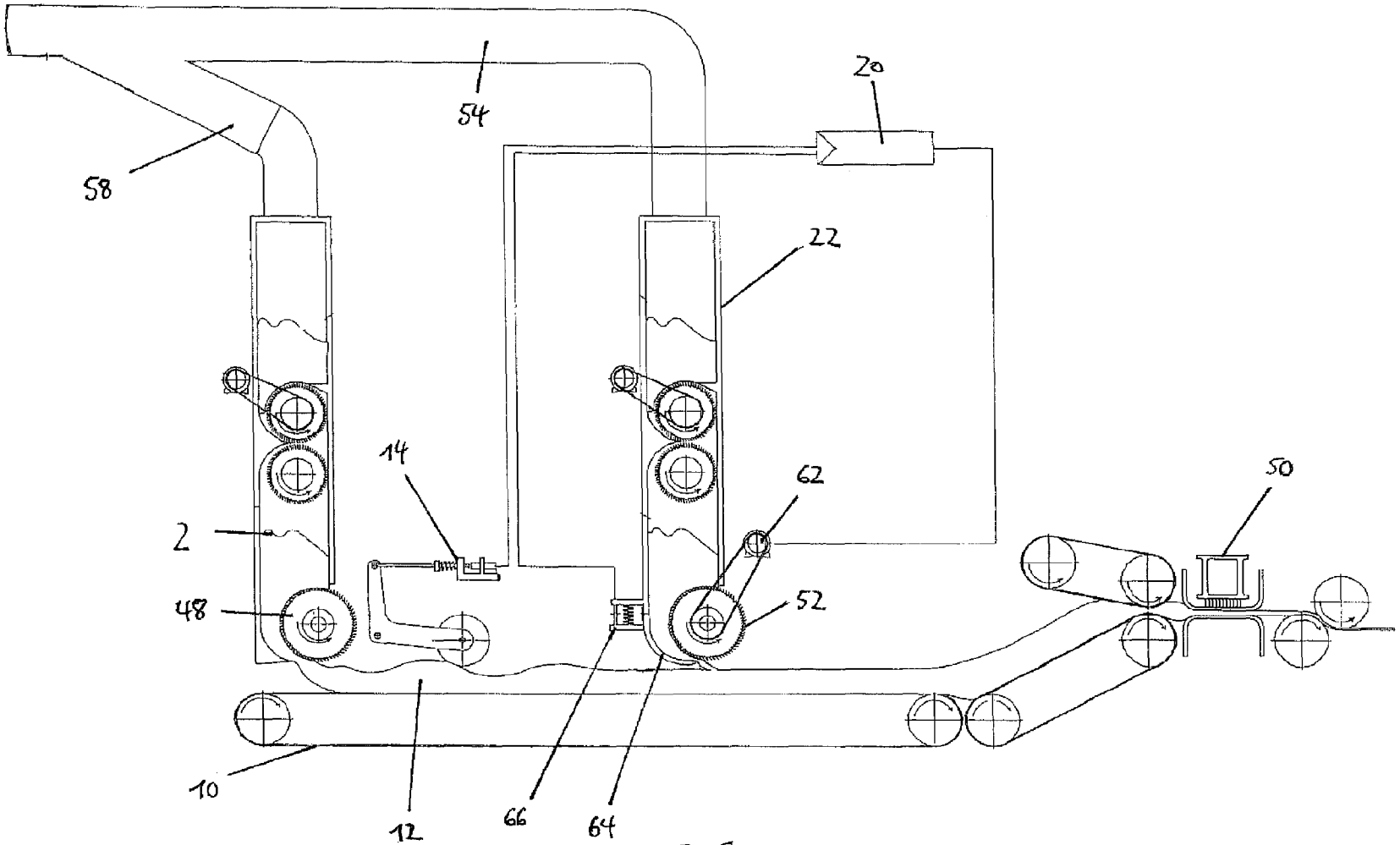
FIG. 3 shows a cross-sectional side view of another embodiment of the device for forming a uniform or profiled fiber flock mat according to the invention.

The embodiment of the device for forming a fiber flock mat shown in FIG. 3 corresponds substantially to the embodiment of FIG. 2, except that here profile-changing device 22 has been slightly modified. Here, one of several base troughs 64, arranged next to each other across the width of fiber flock mat 12, is assigned to each feed segment, opposite the associated outfeed dosing roller 52. The deflection of base troughs 64 is detected by a sensor 66 to determine the actual amount of fiber flock material dispensed in each feed segment. In the cross-sectional side view shown, again only one outfeed dosing roller 52, one base trough 64, and one sensor 66 of the various rows of elements arranged next to each other are illustrated. The measurement results from the sensors 66 are preferably also transmitted to control unit 20, so that the quantity of fiber material actually dispensed by profile-changing device 22 can be determined and the automatic control can be readjusted as needed. In addition to the use of base troughs 64, the deflection of which with respect to their associated outfeed dosing rollers 52 depends on the mass per unit area of the quantity of fiber material which has actually passed through the gap between outfeed dosing roller 52 and base trough 64, and of a corresponding sensor 66, it is also possible to use other types of detectors to measure the mass per unit area of the fiber flock material actually dispensed by profile-changing device 22.

Figure 4:
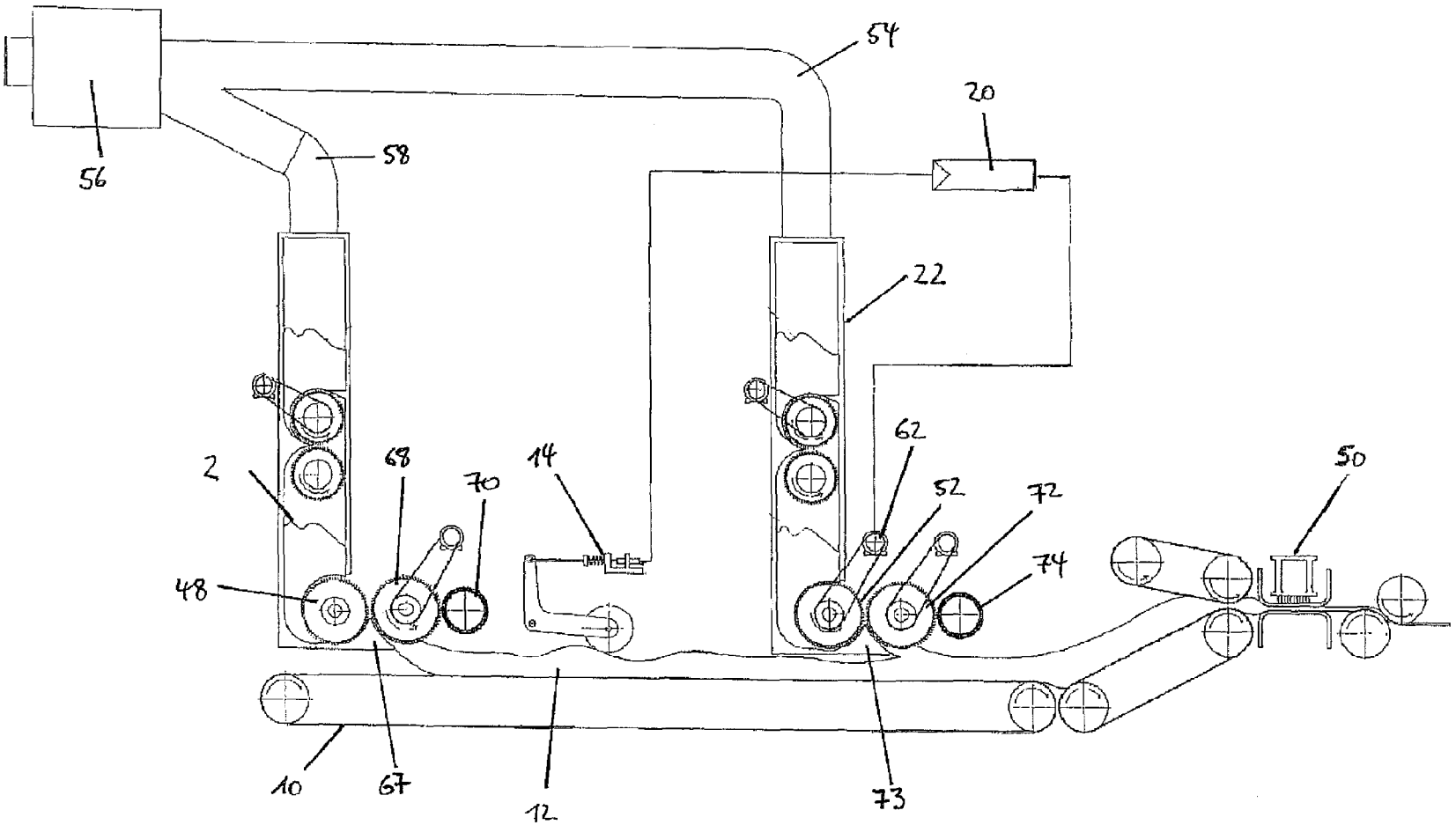
FIG. 4 shows a cross-sectional side view of another embodiment of the device for forming a uniform or profiled fiber flock mat according to the invention.

The embodiment of the device for forming a fiber flock mat shown in FIG. 4 is similar to the embodiment of FIGS. 2 and 3, wherein an opening cylinder 68, which is driven in the same rotational direction as outfeed cylinder 48, is arranged downstream from outfeed cylinder 48 at the bottom end of first fiber flock feeder 2, and is possibly followed by a preferably rubber-coated cleaning cylinder 70. Opening cylinder 68 serves to open even more the fiber flock material coming from outfeed cylinder 48 and carried back upward again by trough 67 and to deposit it in precisely dosed fashion onto the conveyor belt 10, while cleaning cylinder 70 strips off the fiber flock material remaining on the teeth of opening cylinder 68.

In addition to the several outfeed dosing rollers 52, profile-changing device 22 can also comprise an opening cylinder 72 driven in the same rotational direction as outfeed dosing rollers 52. Opening cylinder 72 has the task of opening the fiber flock material coming from outfeed dosing rollers 52 by way of trough 73 even more and of scattering it over conveyor belt 10. Here, too, cleaning cylinder 74 can be provided to strip off the fibers remaining on the surface fittings of opening cylinder 72. Single opening cylinder 72 which extends over the entire width of fiber flock mat 12 can be provided. It is also conceivable that each feed segment and thus each outfeed dosing roller 52 could have its own opening cylinder 72.

Figure 5:
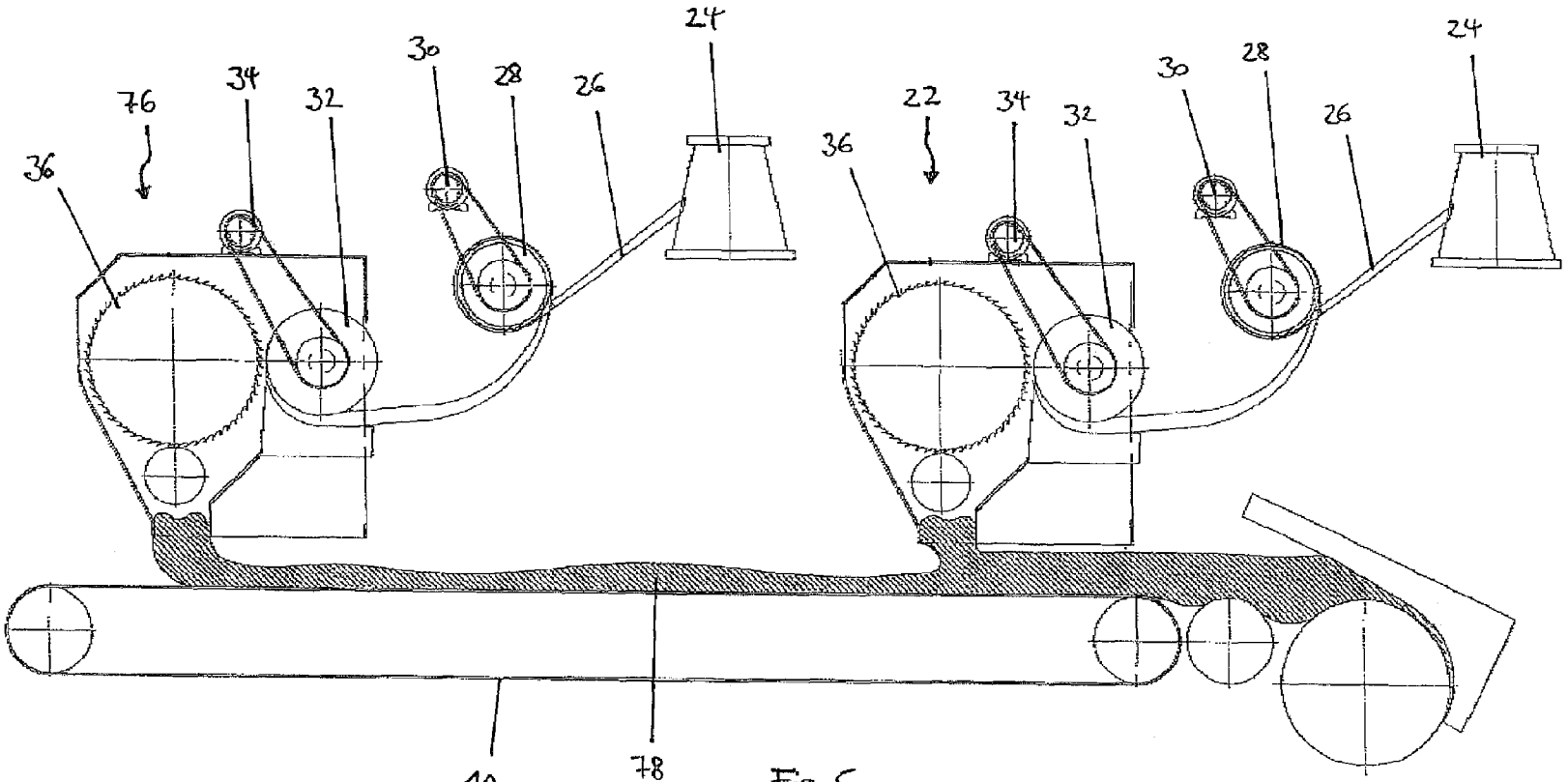
FIG. 5 shows a cross-sectional side view of another embodiment of the device for forming a uniform or profiled fleece according to the invention.

In the embodiment of the device for forming a fleece illustrated in FIG. 5, the material dispensing device is designed as a feed device 76, which is substantially similar to the profile-changing device 22 shown in FIG. 1. The material dispensing device and profile-changing device 22 are thus substantially of similar design. Measuring device 14 arranged between the material dispensing device and profile-changing device 22 and associated control unit 20 have been omitted here for the sake of clarity.

The fleece formed in feed device 76 can have a relatively uniform profile, but it can also show a quite wavy transverse profile. In any case, the device described here, in which both the material dispensing device (feed device 76) and profile-changing device 22 each consist of feed segments arranged next to each other, each segment being supplied with its own fiber sliver 26 or its own fiber fleece strip, makes it possible to form, with a high degree of accuracy, fleece 78 with a profile with the desired properties. In certain embodiments, the feed segments of profile-changing device 22 can be laterally offset from the feed segments of feed device 76 by an amount equal to, for example, half the width of a feed segment.

Figure 6:
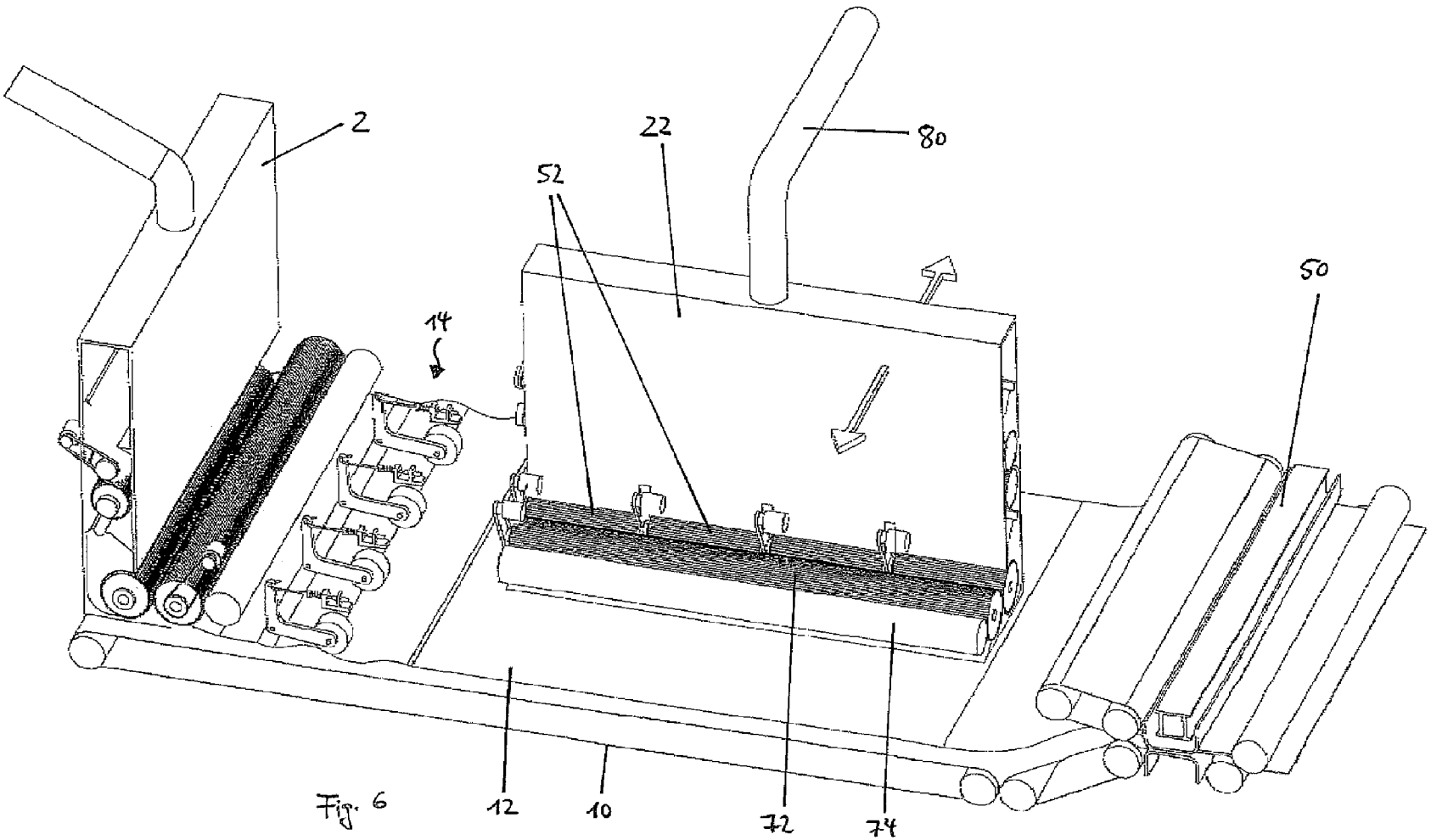
FIG. 6 shows a schematic perspective view of another embodiment of the device for forming a uniform or profiled fiber flock mat according to the invention.

The embodiment of the device for forming a fiber flock mat shown in FIG. 6 corresponds substantially to the embodiment according to FIG. 4 with the difference that profile-changing device 22 is not aligned transversely to the transport direction of conveyor belt 10 but rather in the transport direction of conveyor belt 10. Control unit 20 necessarily also present in this exemplary embodiment has again been omitted for the sake of clarity.

Profile-changing device 22 in this embodiment is again designed as a feed device, but it can be moved transversely to the transport direction of conveyor belt 10 above fiber flock mat 12 to be laid (see the arrows in FIG. 6) and across its maximum width. Here, too, it is preferable for the movable feed device to comprise several feed segments, which are arranged in the transport direction of conveyor belt 10 horizontally next to each other, and which can be actuated independently of each other. The width of each feed segment of the movable feed device is preferably in the range of 5-100 mm, more preferably of 15-30 mm, and even more preferably of 20-25 mm.

With this arrangement it is possible to dispense substantially longitudinally oriented fibers onto conveyor belt 10 in first fiber flock feeder 2 and substantially transversely oriented fibers onto conveyor belt 10 in the profile-changing device 22, so that the material properties of fiber flock mat 12 can be influenced in a targeted manner. Dividing the movable feed device into various feed segments can also increase the spatial resolution during the feed of substantially transversely oriented fibers. In combination with the automatic control based on the measurement result of measuring device 14, fiber flock mats 12 can be formed in this way which are not only highly uniform or which have a highly precise profile but which also comprise different orientations of the fiber or fiber flocks in different areas or layers of fiber flock mat 12 or fleece.

It is important here either that movable profile-changing device 22 comprises a material reservoir traveling along with it or that the feed pipe 80 for profile-changing device 22 is appropriately extendable or retractable so that it can accompany the lateral deflections of profile-changing device 22. When a device for dispensing fiber slivers 26 or fiber fleece strips as shown in FIGS. 1 and 5 is used in conjunction with a transversely movable profile-changing device 22, it also possible for only profile-changing device 22, including feed roller 32, to move transversely, whereas dispensing device 24 remains stationary. If present, storage drum 28 can be moved along with profile-changing device 22 or it can remain stationary. Appropriate hanging storage buffers between the elements just mentioned then provide the necessary material buffering for the transverse travel of profile-changing device 22.

Figure 7:
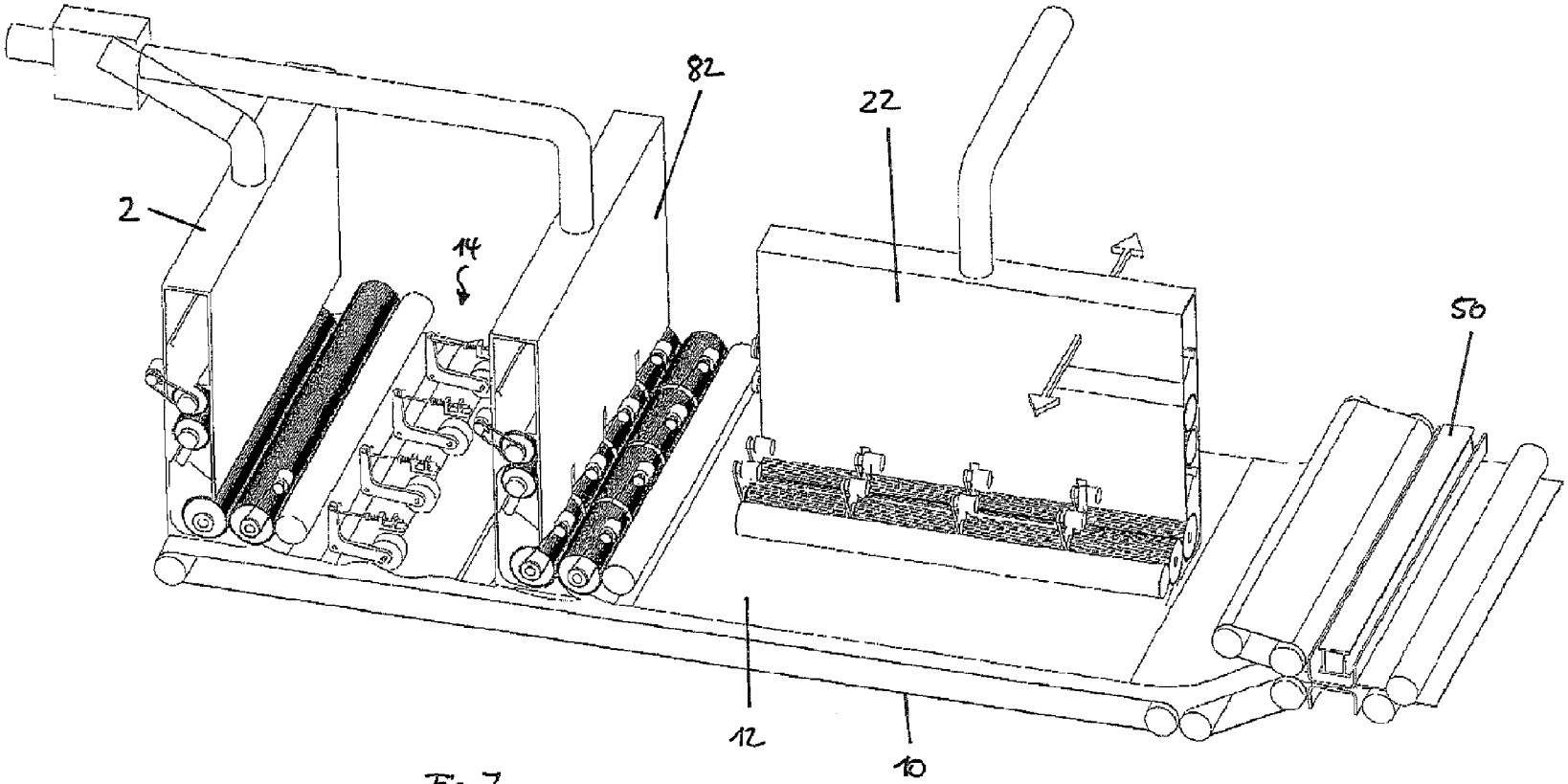
FIG. 7 shows a schematic perspective view of another embodiment of the device for forming a uniform or profiled fiber flock mat according to the invention.

The device for forming a fiber flock mat shown in FIG. 7 corresponds to the embodiment of FIG. 6, wherein another fiber flock feeder 82, which also represents a profile-changing device with individual feed segments, is arranged between first fiber flock feeder 2 and profile-changing device 22. With respect to the particular design of second fiber flock feeder 82, reference can be made to the design of profile-changing device 22 of FIG. 4. The necessarily present control unit 20 has again been omitted from the drawing for the sake of clarity. It is clear, however, that not only the transversely movable profile-changing device 22 but preferably also fiber flock feeder 82 can be controlled by control unit 20.

Additional embodiments of the device according to the invention are shown in FIGS. 8-13. For the sake of clarity, the necessarily present measuring device 14 and the preferably closed-loop control unit 20 are not shown. It should nevertheless be clear that profile-changing device 22, as in the previously described embodiments, is actuated by control unit 20 on the basis of the measurement result provided by measuring device 14.

Figure 8:
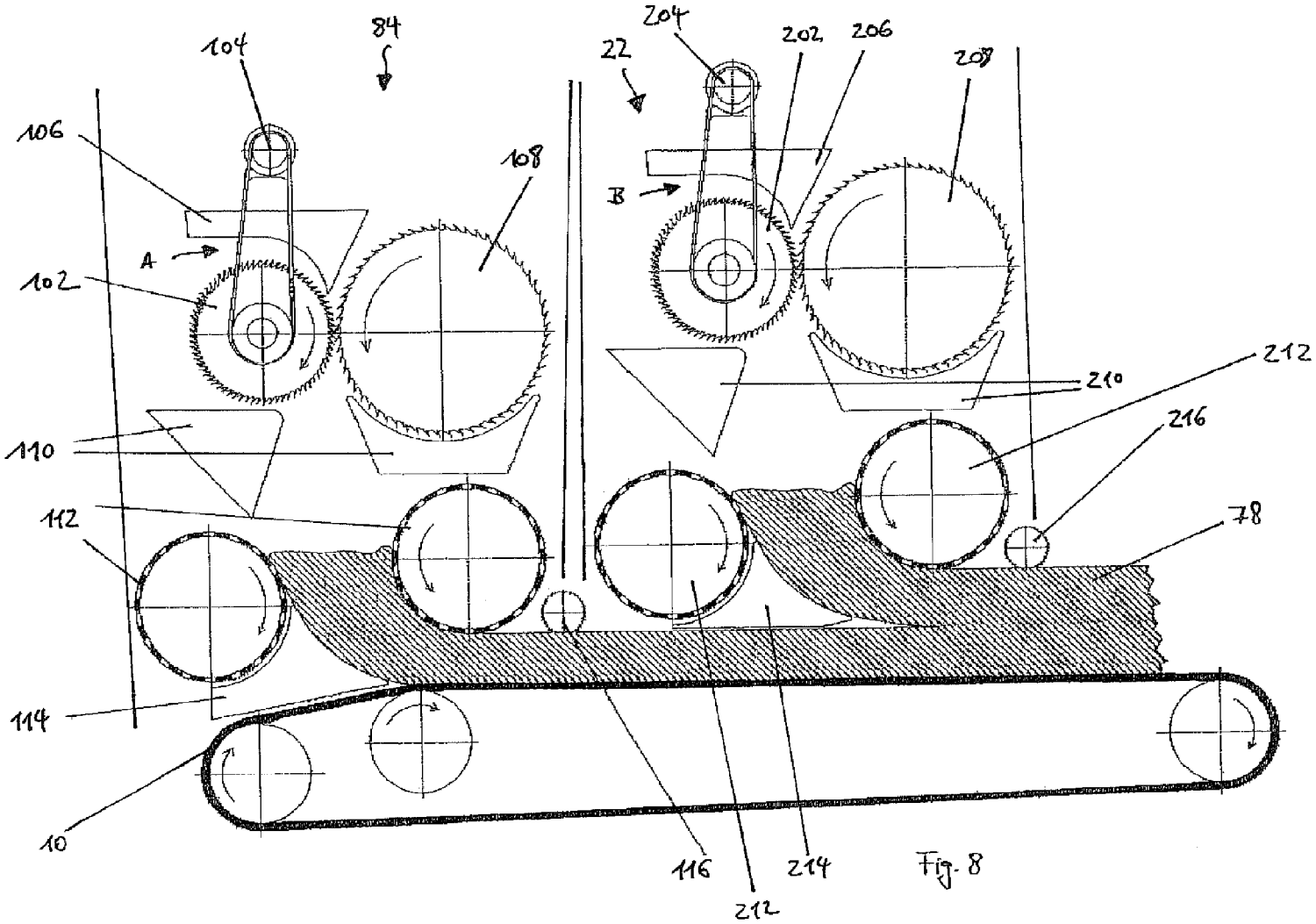
FIG. 8 shows a cross-sectional side view of another embodiment of the device for forming a uniform or profiled fleece according to the invention.

In FIG. 8, the material dispensing device is again designed as a feed device 84 or fleece former, which dispenses a first quantity of fiber material onto conveyor belt 10, which serves as a base for the formation of fleece 78. Feed device 84 comprises a plurality of feed rollers 102, arranged axially next to each other, one of which is assigned to each feed segment of feed device 84. The width of the individual feed segments is preferably similar to the width in the previous embodiments. Each feed roller 102 is driven by its own servomotor 104. In the cross-sectional side view shown, only one feed roller 102 and one servomotor 104 can be seen. The fiber material is drawn in the direction of arrow A by the feed rollers 102 in a controlled manner and thus travels through underneath the overhead trough 106. This trough assists the transport of the supplied fiber material to an opening cylinder 108, which cooperates with the feed rollers 102 and strips off individual fiber flocks or individual fibers from the feed rollers 102. The fiber material supplied in the direction of arrow "A" can be drawn in directly from a fiber flock shaft. The fiber material, however, is preferably supplied in the form of fiber slivers 26 or fiber fleece strips by means of, for example, the elements shown in FIG. 5 for supplying fiber slivers 26 or fiber fleece strips to the feed rollers 32. Whereas, in the case of the embodiment of FIG. 8, an overhead trough 106 is provided and the fiber material is conveyed by feed rollers 102 at an angle from above into the intermediate space between feed rollers 102 and opening cylinder 108, this can, as illustrated in FIG. 5, also be accomplished at an angle from below if desired. Only the relative rotational direction between feed rollers 102 and the opening cylinder 108 would then be different, because feed rollers 102 would then have to move in the same rotational direction as opening cylinder 108.

Depending on the distance between feed rollers 102 and opening cylinder 108 and on the speed difference between feed rollers 102 and faster opening cylinder 108, the opening cylinder 108 opens to different degrees the fiber material of fiber sliver 26 or of the fiber fleece strip or of the fiber flocks coming from the shaft, thus forming either fiber flocks or even individual fibers, which then drop through feed device 84.

Appropriate guide elements 110 can be provided to define the travel of the fiber flocks or fibers. The fiber material individualized per feed segment by opening cylinder 108 finally arrives in an intermediate space between two screen drums 112, which are preferably driven at the same speed but in opposite directions. With the help of, for example, an additional trough 114, these screen drums 112 guide the fiber material in feed device 84 onto conveyor belt 10. The distance between two screen drums 112 and their relative heights are adjustable.

In the outlet area of feed device 84, a clamping cylinder 116 can be provided, which rotates at the same speed as the conveyor belt 10 and compacts the formed fleece 78 between itself and the conveyor belt 10. If the clamping cylinder 116 and conveyor belt 10 are moving faster than screen drums 112, then in the area between screen drums 112 and clamping cylinder 116 fleece 78 will be stretched in the transport direction of conveyor belt 10, which serves to orient the fibers in the fleece even more strongly in the longitudinal direction, i.e., in the transport direction of conveyor belt 10.

Profile-changing device 22 is also designed as a feed device or fleece former, which comprises a plurality of individual fleece-forming locations. The design of profile-changing device 22 is substantially similar to that of first feed device 84 as described above. The feed direction of the fiber material into profile-changing device 22 is shown by the arrow B. The individual elements which have already been described with reference to first feed device 84 have the following reference numbers here: feed rollers 202, servomotors 204, overhead trough 206, opening cylinder 208, guide elements 210, screen drums 212, lower trough 214, and clamping cylinder 216.

Profile-changing device 22 shown in FIG. 8, like profile-changing devices 22 described with reference to the following figures, can also be combined at any time with another material dispensing device, such as with a conventional fiber flock feeder 2 as shown in FIG. 1; with a fiber flock feeder 2 of FIG. 4; or with feed device 76 according to FIG. 5. It is also possible to arrange profile-changing devices 22 shown in FIG. 5 and also in FIGS. 8-13 longitudinally with respect to the transport direction of conveyor belt 10 and to design them so that they are movable as in the case of profile-changing device 22 in the embodiments of FIGS. 6 and 7.

It is also possible to combine the material dispensing devices (first feed device 84) shown in FIGS. 8-13 with other profile-changing devices 22 such as with profile-changing device 22 according to FIG. 5. Generally, any combination of the material dispensing devices and profile-changing devices 22 described here is conceivable. Arranging several profile-changing devices 22 in a row is also possible.

Under certain conditions, the feed segments of profile-changing devices 22 in FIGS. 8-13 can be laterally offset from the feed segments of feed device 84 such as by half of the width of a feed segment.

Figure 9:
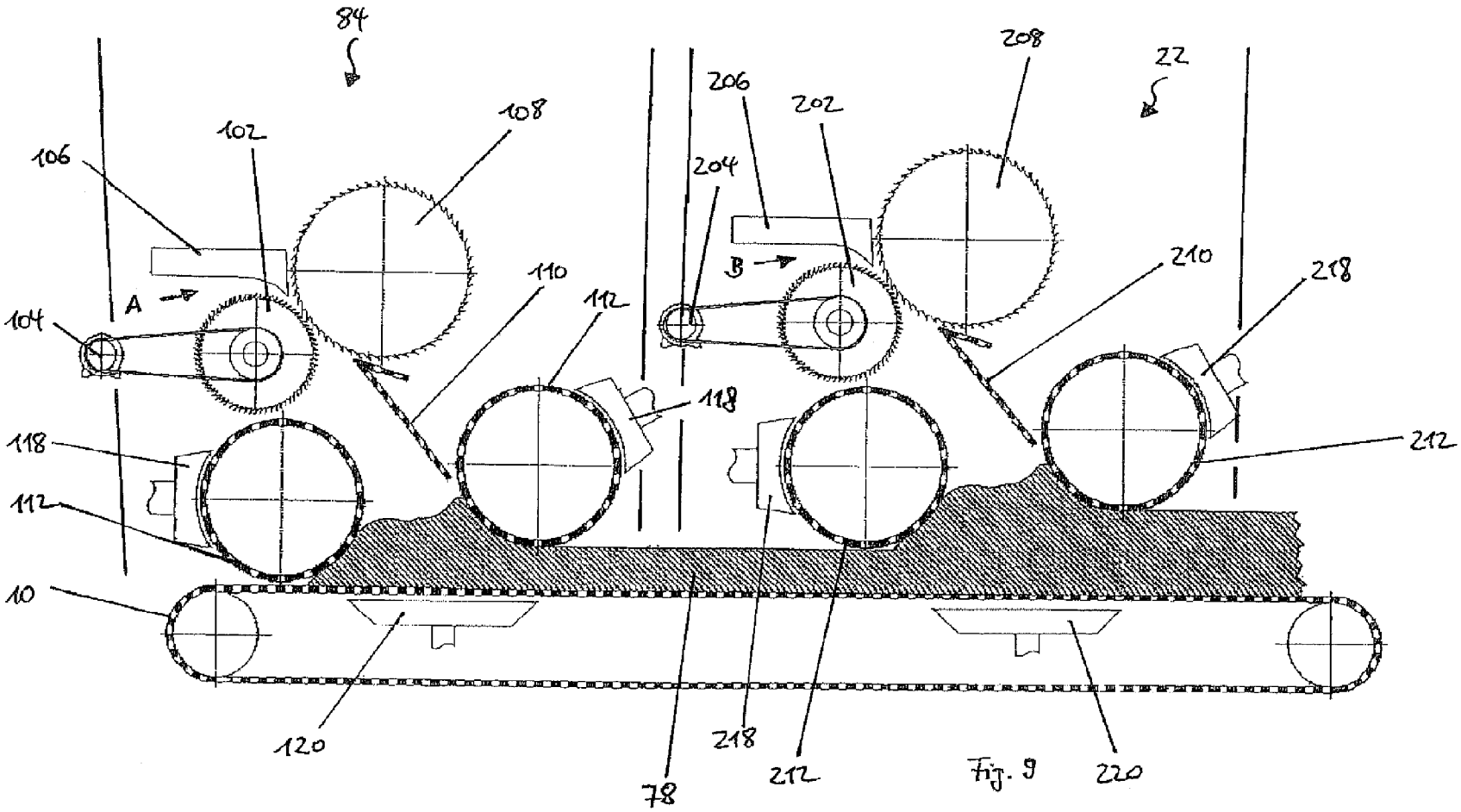
FIG. 9 shows a cross-sectional side view of another embodiment of the device for forming a uniform or profiled fleece according to the invention.

The embodiment of the device for forming a fleece shown in FIG. 9 is similar to the embodiment of FIG. 8. The fiber material is drawn into feed device 84 in the direction of arrow A by means of independently driven feed rollers 102, arranged across the width of fleece 78 to be laid and axially next to each other. Feed rollers 102 in this embodiment are at a slight angle under opening cylinder 108, and a perforated plate is provided in this case as a guide element 110. Two screen drums 112 are again driven in opposite directions, wherein, in the embodiment shown, suction devices 118 for creating suction behind screen drums 112 are also shown. Conveyor belt 10 in the embodiment shown here is designed as a screen belt, underneath which a suction device 120 also creates suction to draw the fiber material stripped from the opening cylinder 108 onto the desired area of conveyor belt 10. In comparison with the embodiment in FIG. 8, furthermore, left screen drum 112 is arranged closer to conveyor belt 10, so that lower trough 114 can be omitted.

Profile-changing device 22 in FIG. 9 is of similar design as first feed device 84. The fiber material is again introduced into profile-changing device 22 in the direction of arrow B. The suction devices for screen drums 212 are designated by the number 218, and the suction device for creating suction underneath conveyor belt 10 in the area of profile-changing device 22 is designated by the number 220. Clamping cylinders 116, 216 (not shown here) of the embodiment according to FIG. 8 could obviously also be used here.

The embodiment of first feed device 84 and of profile-changing device 22 shown in FIG. 10 again comprises, in the infeed area (located above the arrows intended to show the falling fiber material), several feed rollers 102 arranged next to each other and an opening cylinder 108 (as also shown in FIGS. 8 and 9), but not illustrated in FIG. 10.

Figure 10:
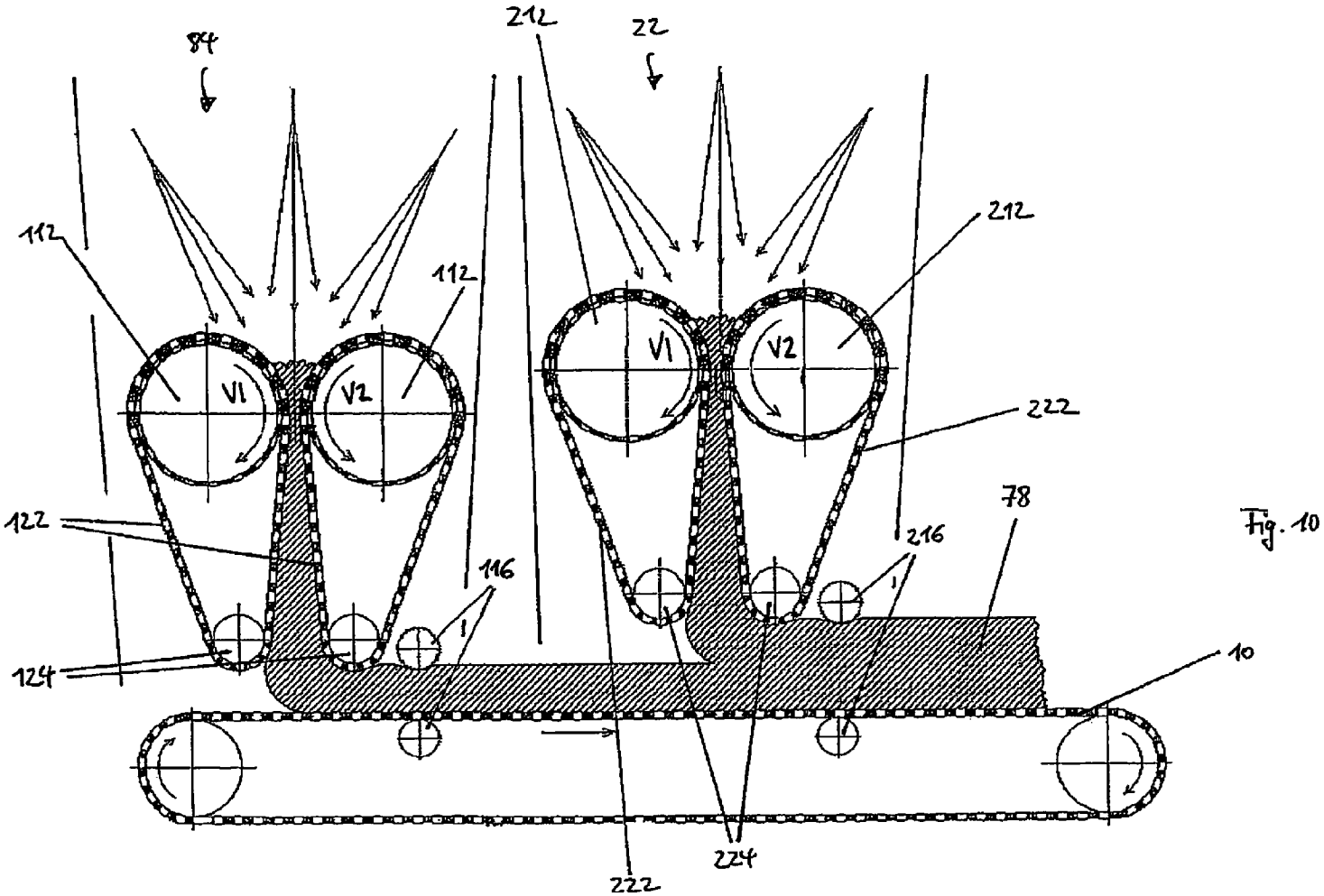
FIG. 10 shows a cross-sectional side view of another embodiment of the device for forming a uniform or profiled fleece according to the invention.

As illustrated in the embodiment of FIG. 10, screen drums 112, which are driven in opposite directions, are partially wrapped by screen belts 122, which are led downward from screen drums 112 and are guided there around smaller deflecting pulleys 124. Deflecting pulleys 124 are arranged close to the surface of conveyor belt 10 and define a dispensing gap of first feed device 84. Conveyor belt 10 is again designed as a screen belt, but this time two opposing clamping cylinders 116 are arranged at the outlet of feed device 84, one above the formed fleece 78 and one under the upper strand of the conveyor belt 10. Clamping cylinders 116 are driven in opposite directions and run at the same speed as conveyor belt 10. When the speed of clamping cylinders 116 and of conveyor belt 10 is higher than the speeds V1 and V2 of screen drums 112, laid fleece 78 is again stretched in the longitudinal direction, that is, in the transport dimension of the conveyor belt. This leads to an increase in the longitudinal orientation of the fibers in fleece 78. It is also possible to omit two clamping cylinders 116 at this point, if no stretching is to be done. The distance between the screen belts 122 is variable, and the speeds V1 and V2 can also be adjusted independently of each other.

In the embodiment of FIG. 10, profile-changing device 22 again is generally similar to first feed device 84, wherein the two endless screen belts have been given the reference number 222 and the two lower deflecting pulleys the reference number 224.

Figure 11:
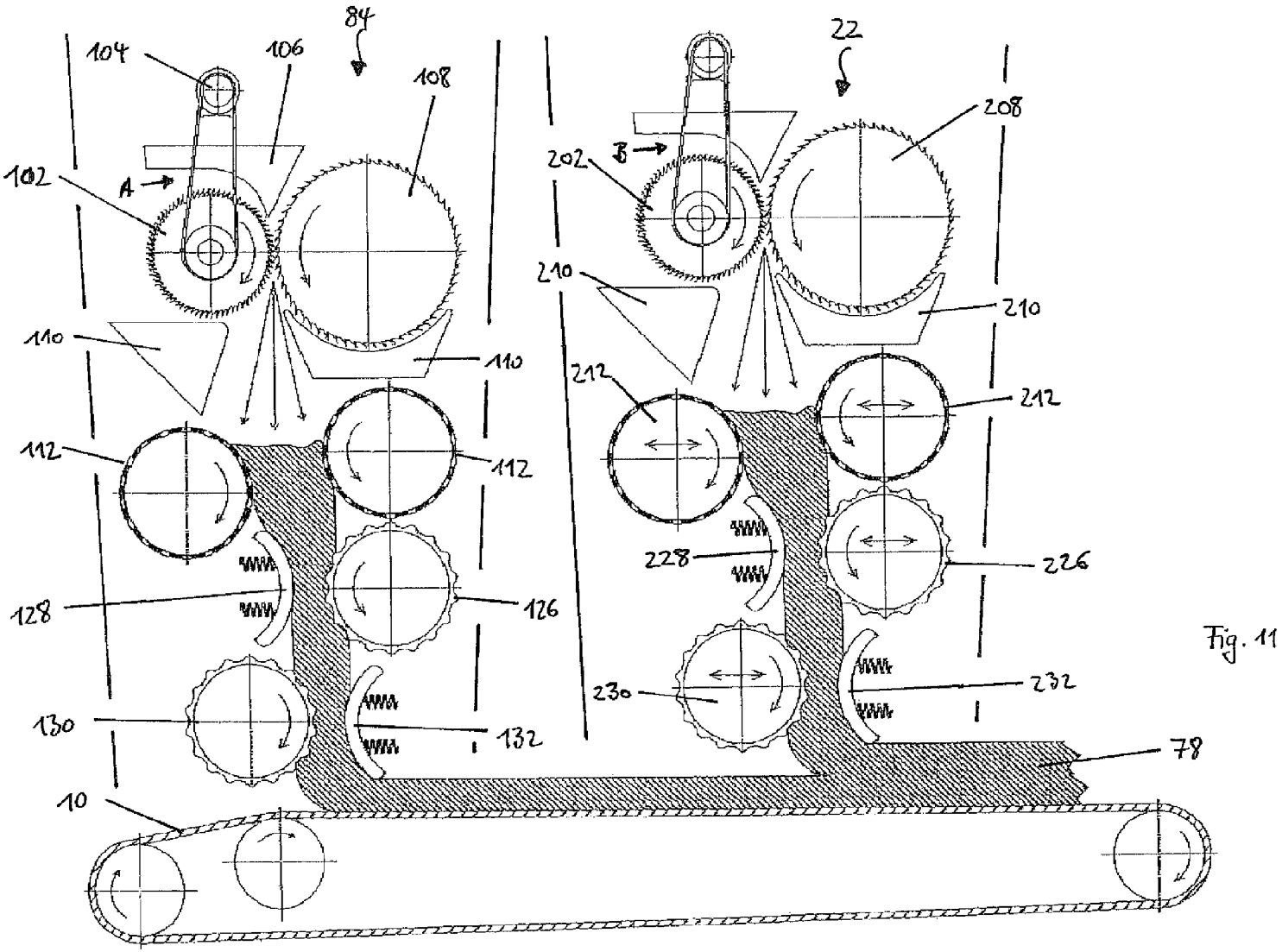
FIG. 11 shows a cross-sectional side view of another embodiment of the device for forming a uniform or profiled fleece according to the invention.

The embodiment of the device for forming a fleece shown in FIG. 11 is substantially similar to the embodiment of FIG. 8 in the upper area up to two screen drums 112. A stretching device is arranged underneath two screen drums 112, however. In this embodiment, the stretching device comprises an upper star cylinder 126 or a cylinder with surface fittings; an opposing, preferably spring-supported counter-pressure plate 128, between which a first clamping point for the fiber material is defined; a lower star cylinder 130 or cylinder with surface fittings; and a lower, preferably spring-supported counter-pressure plate 132, between which a second clamping point is defined. The two star cylinders 126 and 130 are preferably arranged on opposite sides of the filling channel. The fiber material in the filling channel is stretched when the rotational speed of lower star cylinder 130 is higher than the rotational speed of upper star cylinder 126. The speed of lower star cylinder 130 in this embodiment preferably corresponds to the speed of conveyor belt 10. The stretching increases the longitudinal orientation of the fibers, so that ultimately a fleece 78 with fibers oriented more strongly in the transport direction of conveyor belt 10 is laid on conveyor belt 10. The form and arrangement of the elements for stretching can, of course, be varied in many ways. For example, a pair of clamping cylinders (smooth, rubber-coated, or with surface fittings) or a pair of star cylinders can be used to define each clamping point.

Profile-changing device 22 shown in FIG. 11 is substantially similar in design to first feed device 84. Here the fiber material is supplied to profile-changing device 22 in the direction of arrow B, and, in comparison to the embodiment of FIG. 8, the new elements are the upper star cylinder 226, the upper counter-pressure plate 228, the lower star cylinder 230, and the lower counter-pressure plate 232.

Figure 12:
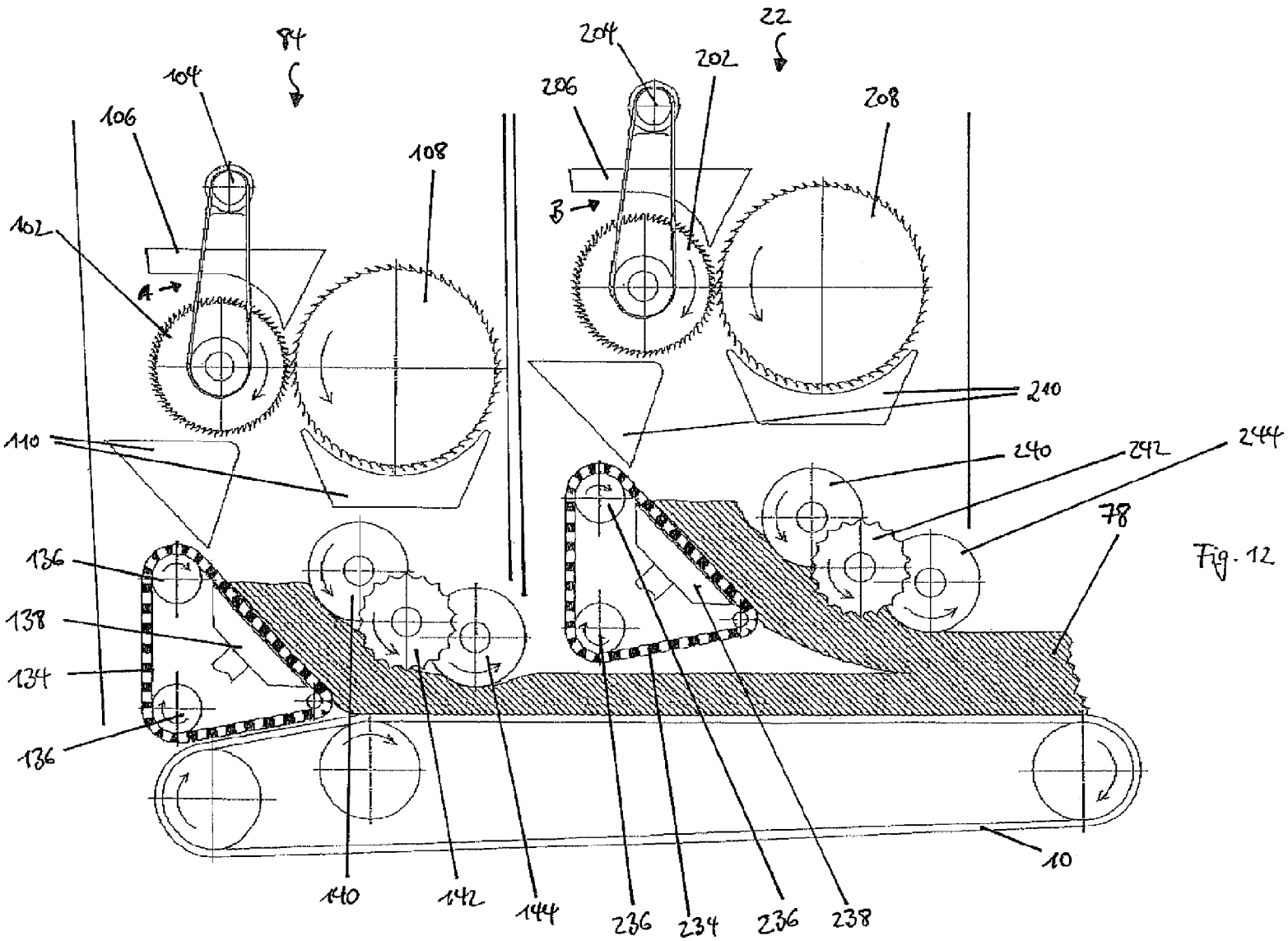
FIG. 12 shows a cross-sectional side view of another embodiment of the device for forming a uniform or profiled fleece according to the invention.

Fleece former 84 shown in FIG. 12 is substantially similar to the embodiment of FIG. 8, wherein two screen drums 112 are replaced by different guide and stretching elements. On the left outer side, screen belt 134 is arranged around several deflecting pulleys 136 in such a way that it defines a slanted guide surface for the fiber material leading toward conveyor belt 10. At least one of the deflecting pulleys 136 is driven so that screen belt 134 travels along at the same speed as conveyor belt 10. In addition, screen belt 134 as shown in FIG. 12 can have a suction device 138 to create suction from underneath. Opposite the slanted guide surface of screen belt 134 is an upper disk-shaped clamping cylinder 140, which is driven at the same speed as screen belt 134 and cooperates with screen belt 134 to define a first clamping point for the transported fiber material. At an angle underneath this clamping cylinder 140, a star cylinder 142 is arranged, which again cooperates with conveyor belt 10 to form a second clamping point for the fiber material. Another clamping cylinder 144 can be provided downstream from star cylinder 142 to densify fleece 78.

A stretching function is present when the speed of star cylinder 142 (which is the same as that of conveyor belt 10) is greater than the speed of the screen belt 134 and clamping cylinder 140. In this way, as already described in detail in the embodiments above, the longitudinal orientation of the fibers of fleece 78 is increased. There are again many different ways in which the individual components can be designed in this embodiment as well.

Profile-changing device 22 of FIG. 12 is substantially similar in design to first feed device 84. The elements which are new in comparison to FIG. 8 are screen belt 234, deflecting pulleys 236, suction device 238, clamping cylinder 240, star cylinder 242, and optional lower clamping cylinder 244.

Feed rollers 102, 202 shown in FIGS. 8-12 are each provided with surface fittings, the teeth of which project forward in the rotational direction of feed rollers 102, 202. It is also possible or even preferable for the teeth of the surface fittings of feed rollers 102, 202 to be directed backward with respect to the direction of rotation. It will be appreciated that many types of surface fittings can be used.

Figure 13:
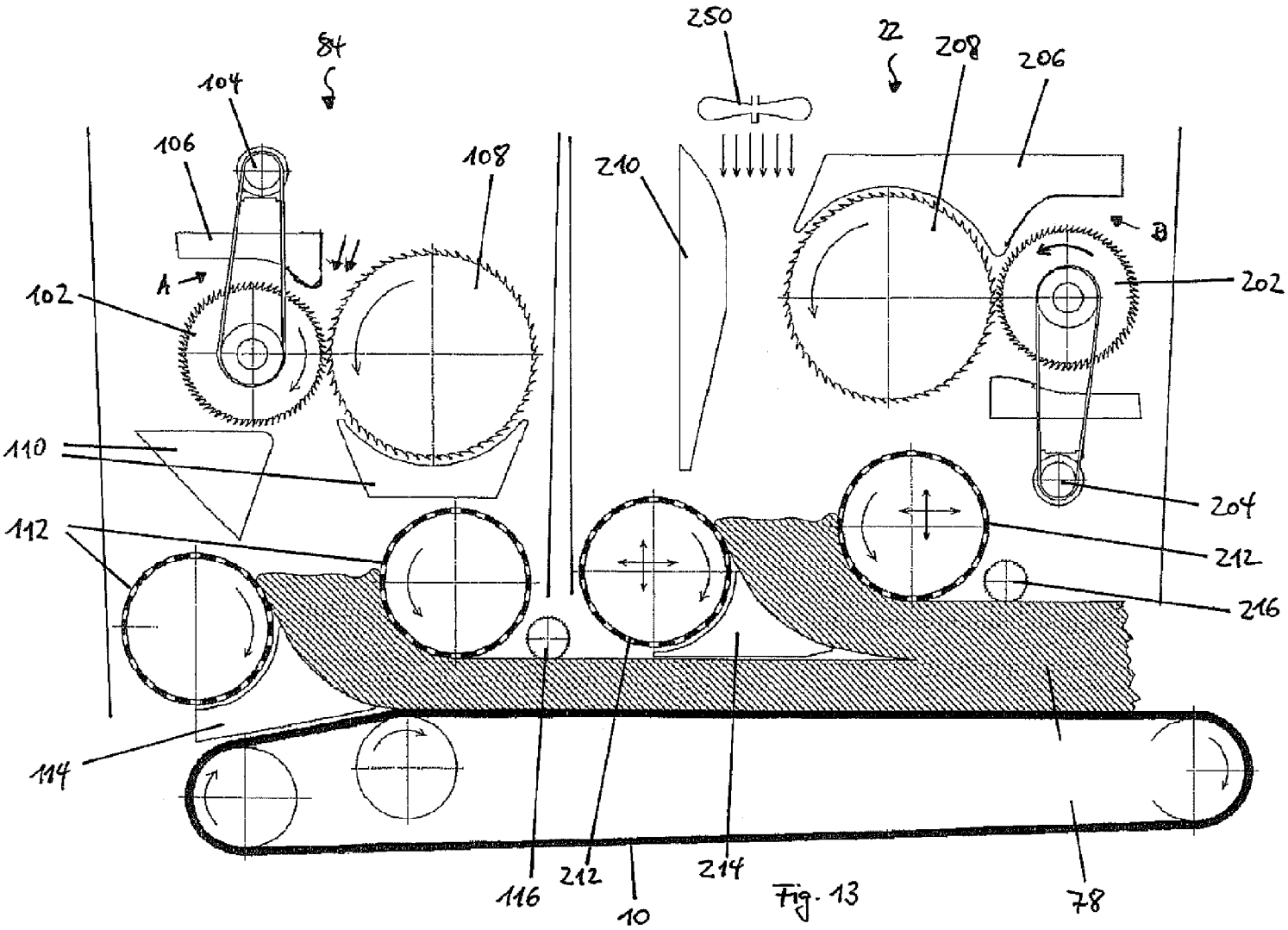
FIG. 13 shows a cross-sectional side view of another embodiment of the device for forming a uniform or profiled fiber flock mat according to the invention.

The embodiment of the device for forming a fleece shown in FIG. 13 comprises a profile-changing device 22, the lower part of which, from screen drums 212 on down, is similar to that of the embodiment seen in FIG. 8. The infeed area, however, is different. The fiber material in this embodiment is introduced above feed rollers 202 in the direction of arrow B and is then conveyed from opening cylinder 208, which turns in the same direction as feed rollers 202, along overhead trough 206. Overhead trough 206 can also have a two-part design. Then, after half a rotation of opening cylinder 208, the fiber material drops into the dispensing shaft and finally arrives between screen drums 212. To assist the process of removing the fiber material from opening cylinder 208, an air stream generator 250 can be used, which allows an air stream to pass by opening cylinder 208 from above (aerodynamic fleece formation).

First feed device 84 of FIG. 13 is substantially similar to feed device 84 seen in FIG. 8. In addition, in the intermediate area between feed rollers 102 and the opening cylinder 108, an air stream from above is provided, as indicated by the arrows, which helps to remove the fiber material from opening cylinder 108 and direct it downward. A measure of this type can also be applied in any of the other embodiments of FIGS. 8-12.

The pre-fleece formed in feed device 84 can have a relatively uniform profile, but it can also have a very wavy transverse profile. In any case, it is possible with the device described here, in which both the material dispensing device (feed device 84) and profile-changing device 22 each consist of adjacent feed segments, each of which is supplied with its own fiber sliver 26 or its own fiber fleece strip, to form a fleece 78 with a profile with the desired properties with extreme accuracy. If desired, the feed segments of profile-changing device 22 can be laterally offset from the feed segments of feed device 84 by a distance equal to, for example, half the width of the feed segment.

In the embodiments of FIGS. 8-13, only feed rollers 102, 202 have been described so far as individually actuatable, axially adjacent elements, each feed roller 102, 202 being assigned to a feed segment of feed device 84 of profile-changing device 22. It is also possible, however, for many other elements of feed device 84 or of profile-changing device 22 shown in FIGS. 8-13 to be segmented, that is, to consist of segments arranged in a row next to each other and to be individually actuated, wherein in each case a segment of these other elements is assigned to each feed segment. This pertains, for example, to screen drums 112, 212, screen belts 122, 222, and star cylinders 126, 130, 226, 230 as well as to screen belts 134, 234, clamping cylinders 140, 240, and star cylinders 142, 242 opposite the belts.

All of the plates, belts, and cylinders shown as screen elements in the figures can be acted on by suction from underneath, or they can merely carry air away passively through the openings. Some of these elements can also be replaced completely by equivalent elements with a solid surface.

The person skilled in the art can also modify the type and design of the selected cylinders, belts, and troughs and the relative geometric arrangement of the individual parts in the embodiments described herein to suit a particular purpose. As an example, the distance between the cylinders and belts in the embodiments of FIGS. 8-13 is not shown to scale and can also be adjusted as desired. The embodiments described herein and the schematic drawings are intended only to represent the basic principle of the inventive idea.

Finally, the elements of the individual embodiments of feed devices 76, 84 and of profile-changing device 22 can be combined with each other in almost any way desired.

Reference throughout this specification to "the embodiment," "this embodiment," "the previous embodiment," "one embodiment," "an embodiment," "a preferred embodiment" "another preferred embodiment" "the example," "this example," "the previous example," "one example," "an example," "a preferred example" "another preferred example" or similar language means that a particular feature, structure, or characteristic described in connection with the embodiment or example is included in at least one embodiment or example of the present invention. Thus, appearances of the phrases "in the embodiment," "in this embodiment," "in the previous embodiment," "in one embodiment," "in an embodiment," "in a preferred embodiment," "in another preferred embodiment," "in the example," "in this example," "in the previous example," "in one example," "in an example," "in a preferred example," "in another preferred example", and similar language throughout this specification may, but do not necessarily, all refer to the same embodiment.

Furthermore, the described features, advantages, and characteristics of the invention may be combined in any suitable manner in one or more embodiments or examples. One skilled in the relevant art will recognize that the invention may be practiced without one or more of the specific features or advantages of a particular embodiment or example. In other instances, additional features and advantages may be recognized in certain embodiments or examples that may not be present in all embodiments of the invention.

While the present invention has been described in connection with certain exemplary or specific embodiments or examples, it is to be understood that the invention is not limited to the disclosed embodiments or examples, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A device for forming a uniform or profiled fleece or a uniform or profiled fiber flock mat, comprising:

a material dispensing device, which produces a fleece or a fiber flock mat of a predetermined width;

a transport device downstream from the material dispensing device for further transport of the fleece or fiber flock mat in a transport direction;

a measuring device for measuring a mass per unit area of the fleece or fiber flock mat across the width of the fleece or fiber flock mat transversely to the transport direction in a measuring area of the transport device to determine a transverse profile and a longitudinal profile of the fleece or fiber flock mat;

a profile-changing device in a profile-changing area downstream from the measuring area, wherein the profile-changing device comprises a feed device for supplying individualized fibers or fiber flocks to the fleece or the fiber flock mat or a removal device for removing individualized fibers or fiber flocks from the fleece or from the fiber flock mat; and a control unit for controlling the profile-changing device on the basis of results of the measuring device in such a way that, to make the fleece uniform, the profile-changing device supplies individualized fibers or fiber flocks to identified thin sections in the fleece or fiber flock mat or removes individualized fibers or fiber flocks from identified thick sections in the fleece or fiber flock mat, or in such a way that, to form a desired nonuniform transverse profile or longitudinal profile of the fleece or of the fiber flock mat with thin sections and thick sections, the profile-changing device supplies or removes individualized fibers or fiber flocks in targeted fashion.

2. The device of claim 1 wherein the measuring device is a radiometric measuring device.

3. The device of claim 1 wherein the measuring device is a mechanical measuring device.

4. The device of claim 3 wherein the measuring device comprises several measuring wheels arranged next to each other transversely to the transport direction, the deflection of the measuring wheels being recorded in an evaluation unit.

5. The device of claim 1 wherein the profile-changing device comprises several feed segments arranged horizontally next to each other transversely to the transport direction, which can be actuated independently of each other by the control unit.

6. The device of claim 5 wherein each feed segment has a width in a range of 5-100 mm.

7. The device of claim 5 wherein each feed segment has a width in a range of 15-30 mm.

8. The device of claim 5 wherein each feed segment has a width in a range of 20-25 mm.

9. The device of claim 1 wherein the material dispensing device is a fiber flock feeder.

10. The device of claim 1 wherein the material dispensing device is a fleece former.

11. The device of claim 1 wherein the feed device for supplying individualized fibers or fiber flocks to the fleece or fiber flock mat comprises several feed rollers arranged next to each other across the width of the fleece or fiber flock mat, which rollers can be actuated independently of each other by the control unit.

12. The device of claim 1 wherein the feed device for supplying individualized fibers or fiber flocks to the fleece or fiber flock mat comprises a fiber flock shaft as a material reservoir.

13. The device of claim 5 wherein a dispensing device for storing and dispensing a fiber sliver or a fiber fleece strip is assigned to each feed segment.

14. The device of claim 1 wherein the material dispensing device is a fiber flock feeder including a plurality of outfeed dosing rollers, wherein the profile-changing device comprises several feed segments, which are arranged horizontally next to each other transversely to the transport direction and which can be actuated independently of each other by the control unit, and wherein the feed device for supplying individualized fibers or fiber flocks to the fiber flock mat comprises a fiber flock shaft as a material reservoir and is designed as a second fiber flock feeder, wherein one of the plurality of outfeed dosing rollers is assigned to each feed segment, the plurality of outfeed dosing rollers can be actuated independently of each other by the control unit.

15. The device of claim 14 including a plurality of deflectable base troughs, wherein one of the plurality of deflectable base troughs is assigned to each feed segment opposite an associated outfeed dosing roller.

16. A method for forming a uniform or profiled fleece or a uniform or profiled fiber flock mat, comprising the steps of:

producing a fleece or a fiber flock mat of predetermined width by means of a material dispensing device;

transporting the fleece or the fiber flock mat further onward in a transport direction by means of a transport device;

measuring a mass per unit area of the fleece or of the fiber flock mat across the width of the fleece or of the fiber flock mat in a measuring area of the transport device to determine a transverse profile and a longitudinal profile of the fleece or of the fiber flock mat; and automatically supplying individualized fibers or fiber flocks to identified thin sections in the fleece or fiber flock mat or removing individualized fibers or fiber flocks from determined thick sections in the fleece or fiber flock mat in a profile-changing area downstream from the measuring area by means of a profile-changing device to make the fleece or fiber flock mat uniform, or automatically supplying individualized fibers or fiber flocks to the fleece or fiber flock mat or removing individualized fibers or fiber flocks from the fleece or from the fiber flock mat in a profile-changing area downstream from the measuring area by means of a profile-changing device to form a desired nonuniform transverse profile or longitudinal profile of the fleece or of the fiber flock mat with thin sections and thick sections.

17. The method of claim 16 wherein the automatically controlled supplying of individualized fibers or fiber flocks is achieved by independent actuation of several feed segments of the profile-changing device arranged horizontally next to each other transversely to the transport direction.

* * * * *